US010729609B2

(12) United States Patent
Du Bruyn

(10) Patent No.: US 10,729,609 B2
(45) Date of Patent: Aug. 4, 2020

(54) GRAVESTONE MARKER WITH PROTECTED VIEWING CHAMBER

(71) Applicant: Izak Du Bruyn, Kansas City, MO (US)

(72) Inventor: Izak Du Bruyn, Kansas City, MO (US)

( * ) Notice: Subject to any disclaimer, the term of this patent is extended or adjusted under 35 U.S.C. 154(b) by 0 days.

(21) Appl. No.: 16/289,060

(22) Filed: Feb. 28, 2019

(65) Prior Publication Data

US 2019/0192369 A1 Jun. 27, 2019

Related U.S. Application Data

(63) Continuation-in-part of application No. 15/403,535, filed on Jan. 11, 2017, now abandoned, which is a continuation-in-part of application No. 14/931,106, filed on Nov. 3, 2015, now abandoned, which is a continuation of application No. 14/228,637, filed on Mar. 28, 2014, now Pat. No. 9,175,495.

(51) Int. Cl.
*A61G 99/00* (2006.01)
*E04H 13/00* (2006.01)

(52) U.S. Cl.
CPC ..... *A61G 99/00* (2013.01); *E04H 13/003* (2013.01); *E04H 13/00* (2013.01)

(58) Field of Classification Search
CPC ..... E04H 13/003; E04H 13/008; E04H 13/00; F41H 5/263; A61G 99/00
See application file for complete search history.

(56) References Cited

U.S. PATENT DOCUMENTS

| | | | | |
|---|---|---|---|---|
| 1,274,809 | A | 8/1918 | Storm, Jr. | |
| D89,766 | S | 9/1932 | Hull | |
| 3,438,159 | A | 4/1969 | Bergener et al. | |
| 4,790,088 | A | 12/1988 | Morvant | |
| 4,831,754 | A | 5/1989 | Tallent | |
| 5,363,609 | A | 11/1994 | Hancovsky | |
| 5,404,343 | A | 4/1995 | Boggio | |
| 5,546,710 | A * | 8/1996 | Barry | E04H 13/003 52/104 |
| 5,732,515 | A * | 3/1998 | Rodrigues | E04H 13/003 312/102 |
| 5,787,625 | A | 8/1998 | Yesbick | |
| D436,758 | S | 1/2001 | Rodrigues | |
| 6,526,636 | B2 | 3/2003 | Bernhardt | |
| 6,980,107 | B1 | 12/2005 | Ziegler | |
| 7,089,495 | B2 | 8/2006 | Barrows | |
| 7,191,499 | B2 | 3/2007 | Davis et al. | |

(Continued)

FOREIGN PATENT DOCUMENTS

JP 08043556 A * 2/1996

*Primary Examiner* — Basil S Katcheves
*Assistant Examiner* — Omar F Hijaz
(74) *Attorney, Agent, or Firm* — Law Office of Mark Brown, LLC; Christopher M. DeBacker

(57) ABSTRACT

A gravestone marker made from a single slab of granite that is carved and cut. A bulletproof, transparent covering for a viewing chamber allows for placement of photographs and other small objects within the chamber. The chamber is carved out of the granite slab, and a back wall is cut from the slab and reattached to enclose the chamber. This allows for smoothing and polishing of the chamber prior to reattachment of the back wall. Luminescent sand can be placed within the chamber to provide illumination to the objects stored within.

1 Claim, 5 Drawing Sheets

(56) References Cited

U.S. PATENT DOCUMENTS

| | | | | |
|---|---|---|---|---|
| 7,793,393 | B2 * | 9/2010 | Roberts | A61G 17/08 27/1 |
| 3,068,035 | A1 | 11/2011 | Salcedo et al. | |
| D687,205 | S * | 7/2013 | Vanacore | D99/17 |
| 8,499,425 | B2 * | 8/2013 | Roberts | A61G 17/08 27/1 |
| 8,595,969 | B1 | 12/2013 | Wheelis et al. | |
| 9,175,495 | B1 * | 11/2015 | Bruyn | A61G 99/00 |
| 2001/0025459 | A1 | 10/2001 | Barnes | |
| 2001/0036354 | A1 | 11/2001 | Majors | |
| 2004/0085337 | A1 * | 5/2004 | Barrows | E04H 13/003 715/717 |
| 2005/0126058 | A1 * | 6/2005 | Rojdev | A47G 7/06 40/124.5 |
| 2006/0236326 | A1 * | 10/2006 | Aguirre | G06F 1/1626 719/322 |
| 2007/0084743 | A1 * | 4/2007 | Chu | A47G 1/14 206/455 |
| 2009/0123344 | A1 * | 5/2009 | Dobler | A61L 9/048 422/123 |
| 2011/0099778 | A1 * | 5/2011 | Johnson | A61G 17/08 27/1 |
| 2012/0180275 | A1 * | 7/2012 | Kocir | A61G 17/08 27/1 |

* cited by examiner

GRAVESTONE MARKER WITH PROTECTED VIEWING CHAMBER

CROSS-REFERENCE TO RELATED APPLICATION

This application is a continuation in part of U.S. patent application Ser. No. 15/403,535 filed Jan. 11, 2017, which is a continuation in part of U.S. patent application Ser. No. 14/931,106 filed Nov. 3, 2015, which is a continuation of U.S. patent application Ser. No. 14/228,637 filed Mar. 28, 2014, now U.S. Pat. No. 9,175,495, all of which are incorporated herein by reference.

BACKGROUND OF THE INVENTION

1. Field of the Invention

The present invention relates generally to gravestone markers and method for use thereof, and more specifically to gravestone markers constructed from a solid slab of granite and including a protected viewing chamber.

2. Description of the Related Art

The use of gravestone markers to honor the memory of persons who have passed away, especially family members, using granite or other stone is well known in the prior art. While a granite tombstone or gravestone marker that is engraved with information is a time enduring memorial, it would be desirable to include memorabilia in addition to the tombstone to honor the love one that has passed away. For example, it would be desirable to provide photographs and perhaps other small objects and memorabilia at the grave site that could remain there perpetually as long as the gravesite is there.

The invention described in this patent application accomplishes these objectives by providing a granite gravestone marker that includes a protected viewing chamber having a clear transparent cover or display window of bulletproof material either glass or acrylic. The protected viewing chamber is also weatherproof, waterproof, and moisture proof.

Heretofore there has not been available a system or method for a gravestone marker with the advantages and features of the present invention.

BRIEF SUMMARY OF THE INVENTION

A gravestone marker comprising a slab of granite including top and bottom walls, left and right-side walls, and a back wall. A front wall face includes a chamber that has been hollowed out of the granite slab. The front face granite chamber includes a second hollowed out opening ledge surrounding the granite slab chamber opening.

The granite slab chamber is sized to receive small objects including photographs and small memorabilia. A translucent clear sheet of bullet proof glass or plastic is sized in length, width, and thickness to fit snuggly into the granite chamber L-shaped peripheral ledge defining the opening the chamber. The glass sheet also receives adhesive around the edge surfaces of the clear sheet of glass that allows the sheet to be permanently installed over the granite slab chamber. The glass sheet forms a display window.

In an alternative embodiment, a portion of the granite slab rear or back wall can be cut away from the granite slab and temporarily separated to allow polishing the interior walls of the granite chamber near each corner of the granite slab chamber. The back granite cutaway wall is reattached to the granite slab by a permanent adhesive once the chamber interior walls are polished.

The protected permanent viewing chamber is large enough to receive small objects of memorabilia and photographs that can be positioned in a secure chamber that can be viewed by a person standing next to the gravesite.

The bulletproof glass protective sheet that is translucent is sized and shaped to fit snugly in the granite chamber peripheral ledge with waterproof granite epoxy adhesive. The glass sheet can also be attached to the granite frame with other waterproof adhesives.

It is an object of the invention to provide an improved gravestone marker made from a single slab of granite such that the marker has a protected viewing chamber that is protected from the outdoor environmental, harsh elements, and vandalism.

It is another object of the invention to provide a gravestone marker that allows relatives and friends the ability to view memorabilia and photographs at a gravesite into a viewing chamber that is permanently accessible outdoors.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Gravestone Marker 10

Figure 1:
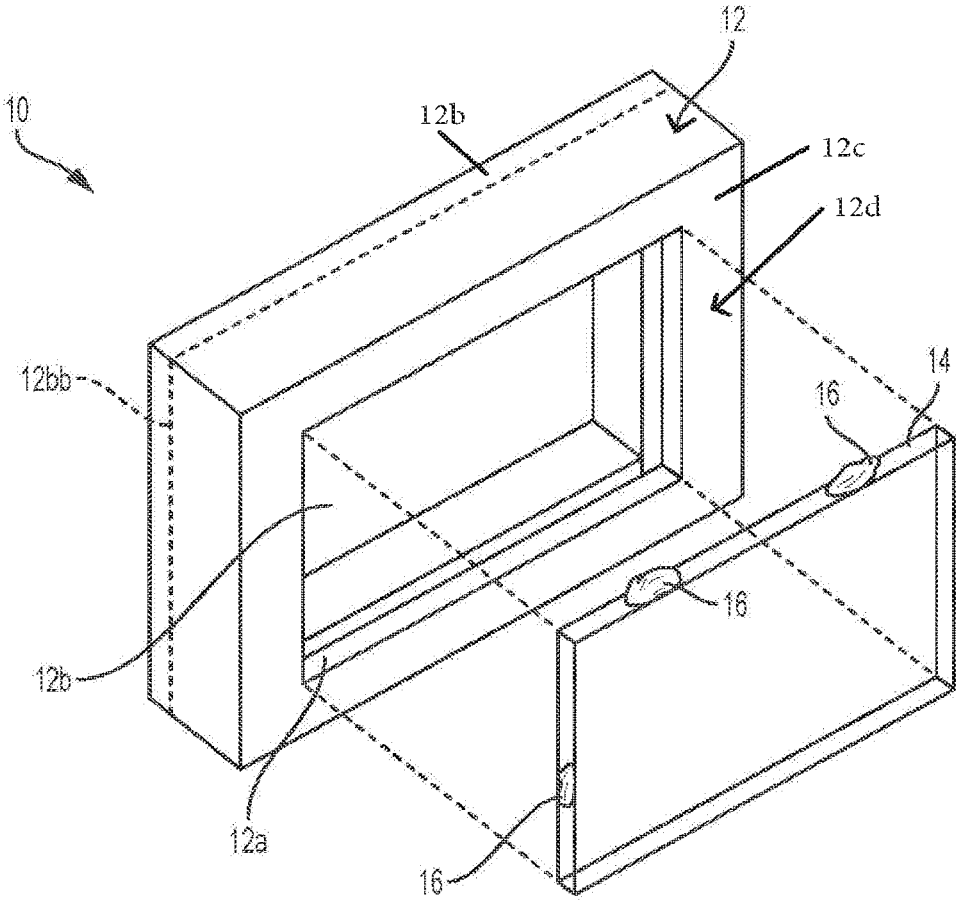
FIG. 1 is a three-dimensional partially-exploded isometric view of a preferred embodiment of the present invention with the gravestone marker with protected viewing chamber that includes a granite back wall cut from the entire piece and attached back on the marker.

Referring to the figures in more detail, FIG. 1 shows a gravestone marker 10 comprising a slab of granite 12 that has been cut and polished into a rectangular gravestone marker 10, having top and bottom walls, parallel side walls, and a back wall glued to the other walls. The front wall 12*c* has a central rectangular volume chamber 12*d* that has been hollowed out of the granite slab 12. The back wall 12*b* forms and interior wall of chamber 12*d*. The back wall 12*b* was originally part of the initial granite slab 12 and was cut along the line 12*bb* so that the back wall 12*b* was removed to allow the interior walls of chamber 12*d* to be highly polished especially along the rectangular interior wall corners. Once the interior chamber 12*d* walls are polished, the back wall 12*b* is permanently attached by adhesive along line 12*bb* to the granite slab 12 providing for the chamber 12*d*. The chamber 12*d* opening includes a peripheral rectangular supporting L-shaped ledge 12*a* that is sized to receive a permanent glass or plastic transparent sheet 14 that forms a display window. The plastic or glass sheet 14 is bulletproof and transparent. The plastic or glass sheet 14 is attached to the rectangular granite slab 12 within L-shaped support ledge 12*a* using adhesive 16 around the peripheral edge of sheet 14 for permanent attachment to the granite rectangular gravesite marker 10, sealing the chamber 12*d* from moisture and air.

However, before the bulletproof glass display window 14 is manually put in place with epoxy adhesive, against granite L-shaped peripheral support ledge 12*a*, memorabilia such as photographs and other small objects (not shown) to honor the deceased are placed within the chamber 12*d*. The display window 14 is then permanently attached with adhesive 16 to the granite slab 12. The memorabilia can be viewed through the display window 14 once in place. The glass material for the display window is made of a durable glass or acrylic plastic that can be bulletproof, waterproof, and hermetically sealed to protect the photographs and other objects placed in the granite marker chamber 12*d*.

Figure 2:
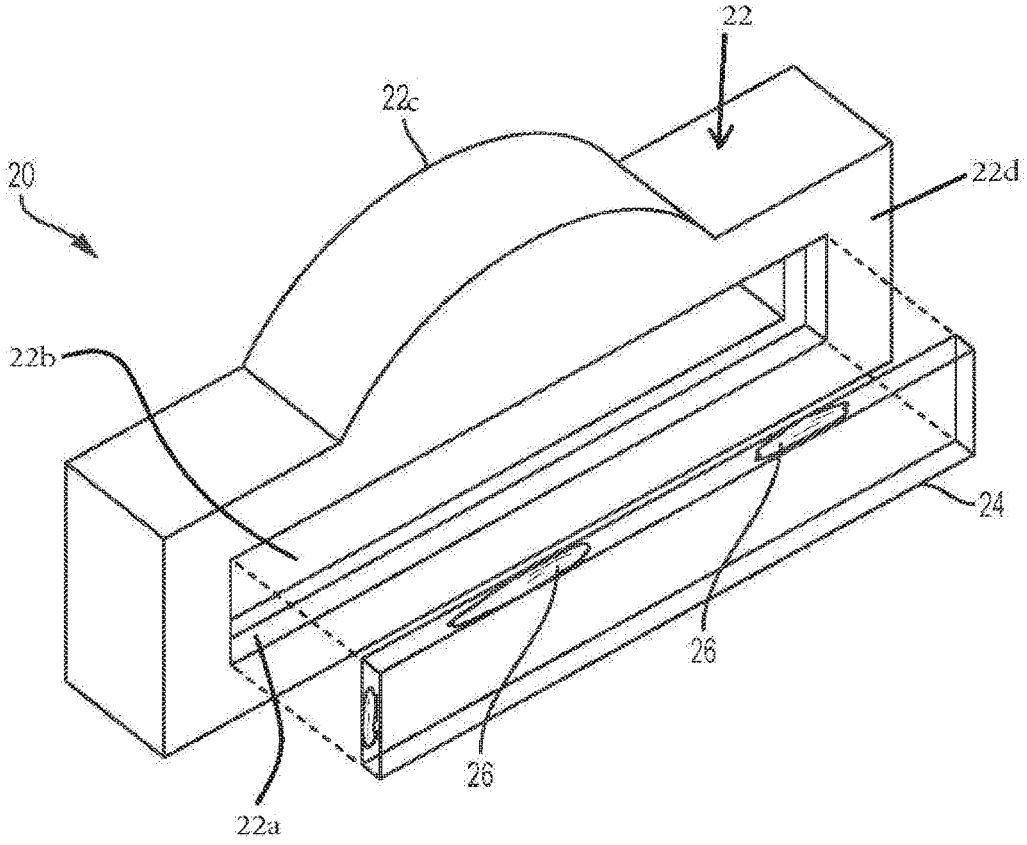
FIG. 2 is a three-dimensional partially-exploded isometric view of an alternative embodiment of the present invention made from a solid granite piece.

FIG. 2 shows an alternate embodiment of the invention in which the grave marker 20 is comprised of a granite slab 22 that is substantially rectangular except for a curved upper top wall 22*c*. The grave marker 20 is cut from a single slab of granite. The front wall 22*d* has a hollowed-out chamber 22*b* that can receive memorabilia such as photographs or other memorabilia that will be permanently stored in chamber 22*b* once the transparent glass or plastic window 24 is permanently attached to the granite L-shaped ledge 22*a* with the appropriate epoxy adhesive 26 disposed around the periphery of the bulletproof glass window 24. In this embodiment there is no cutting away of the granite back wall. The interior chamber 22*b* walls can be hand polished along the corners and edges. Therefore, once the transparent glass or plastic bulletproof window 24 has been permanently inserted with epoxy 26, the interior chamber 22*b* which contains photographs of memorabilia is permanently sealed and protected against gunfire, water, rain, and the elements. The sheer weight and size of the granite slab 22 allows the grave marker 20 to be placed in the appropriate location in a cemetery or other appropriate place that receives grave markers.

Figure 3:
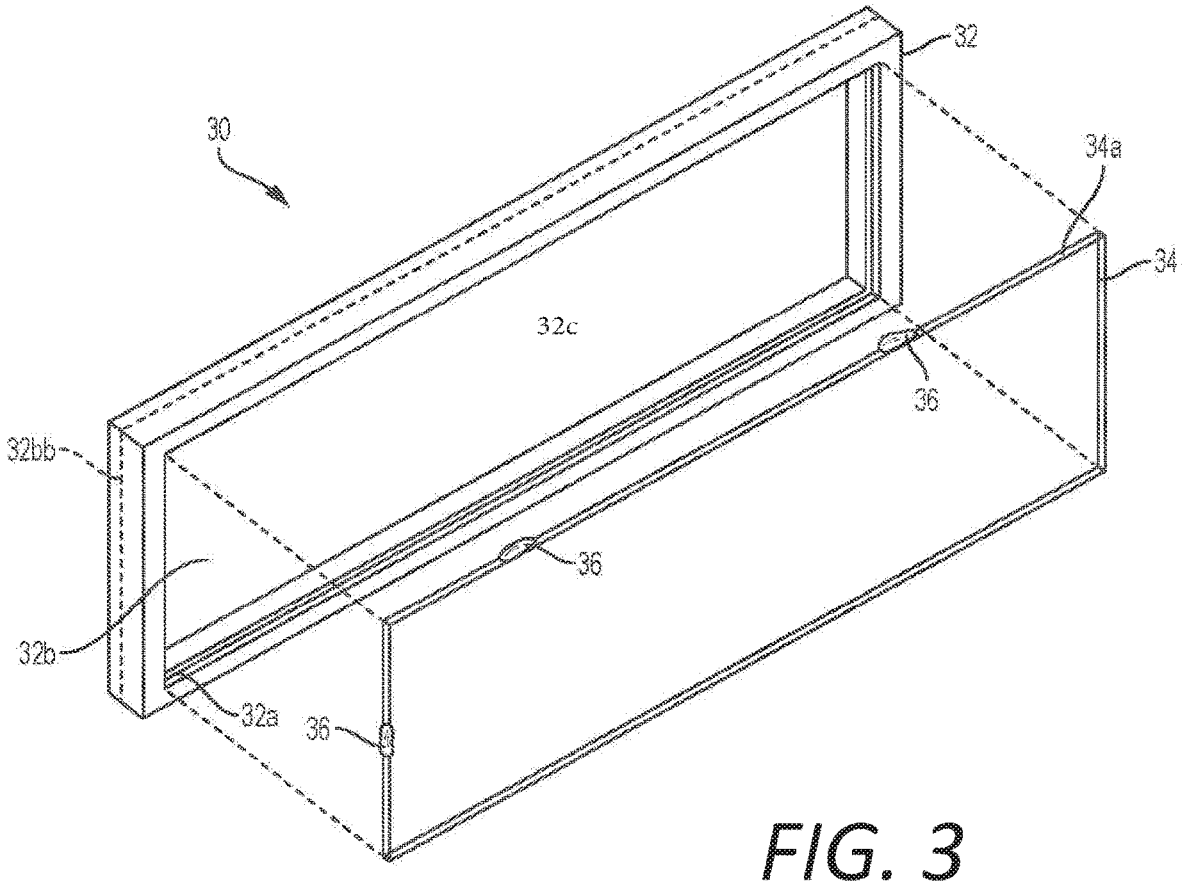
FIG. 3 shows a three-dimensional exploded isometric view of the embodiment of FIG. 1.

FIG. 3 shows the embodiment disclosed above and described with regard to FIG. 1, except that the proportions of the rectangular granite structure are modified. The grave marker 30 is rectangular in shape made from the granite slab 32 that has been cut to provide a chamber 32*c*. The grave marker 30 back wall 32*b* has been cut and removed from the slab 32 along the line 32*bb*, to allow polishing of the corners and edges of the interior walls of the granite chamber 32*c*. After the polishing is completed, the back wall 32*b* is permanently attached again the grave marker 30 along line 32*bb* with permanent epoxy adhesive 36 to permanently form a chamber 32*c* that can receive photographs and/or memorabilia or both. The bulletproof display window 34 is then permanently sealed to an L-shaped ledge 32*a* in the grave marker 30 using epoxy adhesive 36 that is disposed around the peripheral edges 34*a* of the display window 34.

With expect to the first embodiment of the invention, a granite slab is selected with the objective to include removal of a back-chamber wall for a short period of time to allow the granite chamber interior walls to be polished along the chamber edges and corners. After the polishing is finished, the same granite back wall is permanently attached back to the grave marker with appropriate epoxy adhesive in such a way that an observer would believe that the grave marker is basically made from a single slab that has not been cut.

Both embodiments of the invention provide for a well-protected grave marker that includes photographs and memorabilia that are protected from bullets, vandalism, and the elements in an outdoor setting.

III. Alternative Embodiment Gravestone Marker 50 with Luminescent Sand 62

Figure 4:
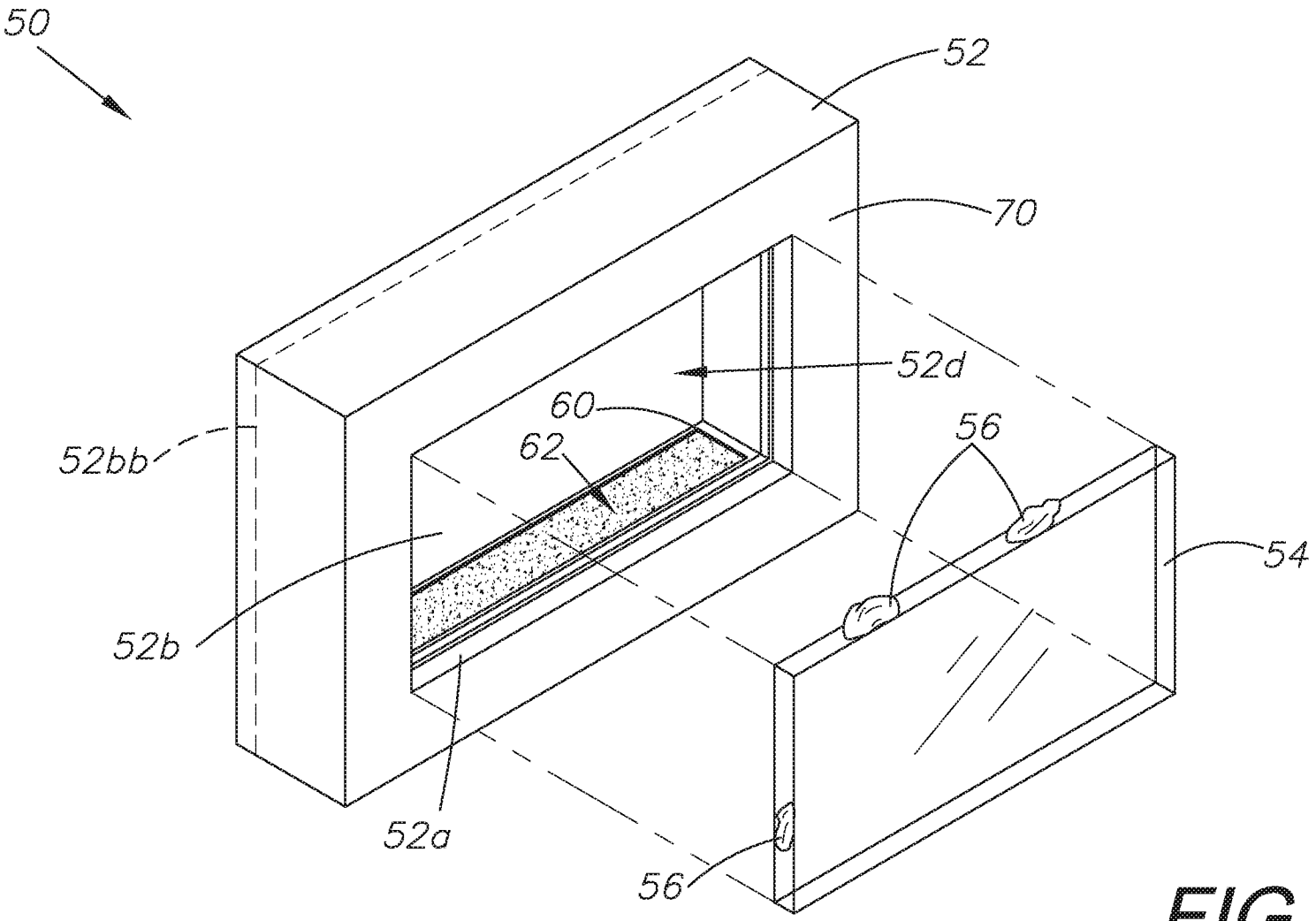
FIG. 4 is a three-dimensional partially-exploded isometric view of another alternative embodiment of the present invention.
Figure 5:
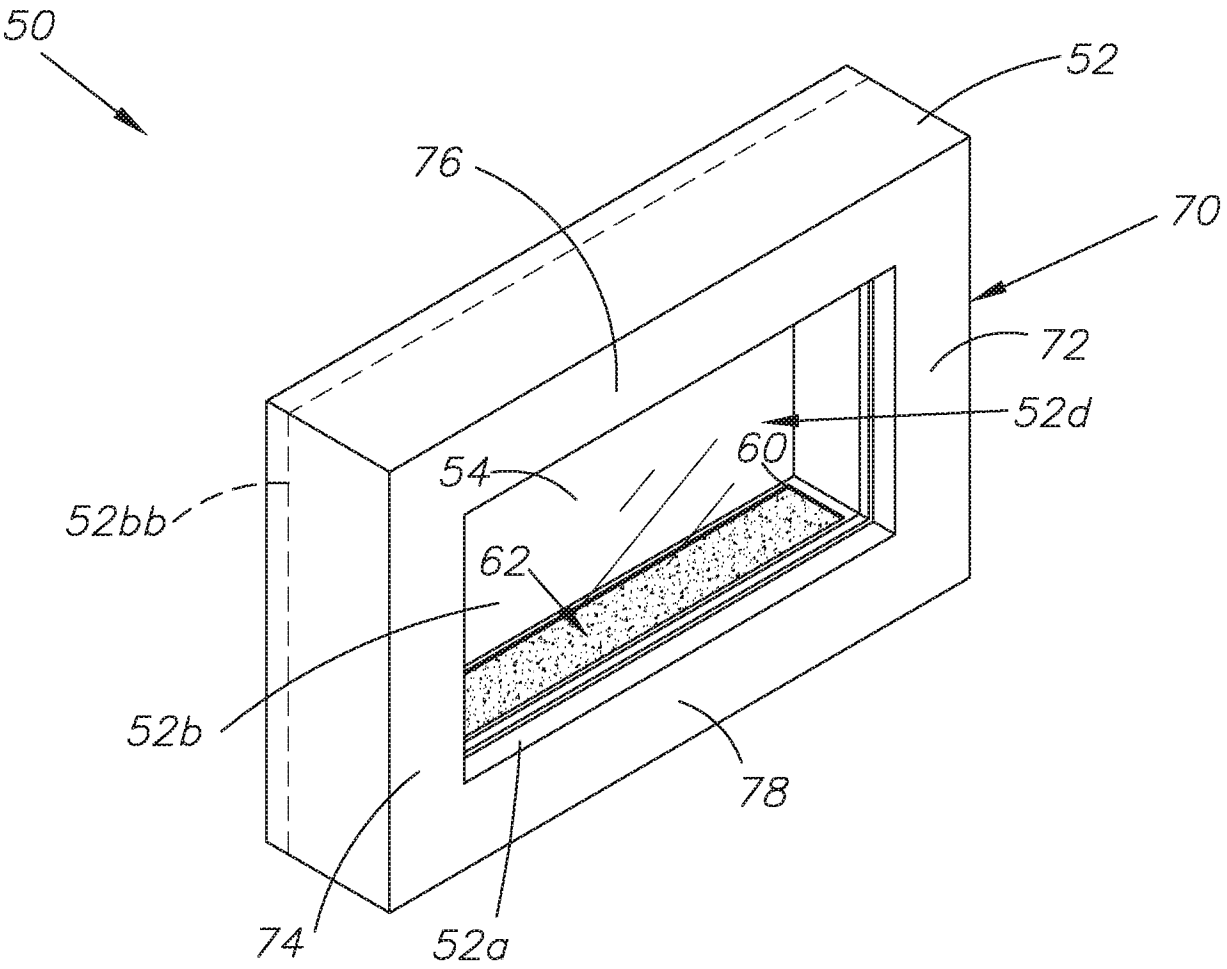
FIG. 5 is a three-dimensional isometric view of an embodiment thereof shown as assembled.

FIGS. 4 and 5 show an alternative embodiment to the first embodiment disclosed above which includes luminescent sand 62 for illuminating the interior of the viewing chamber 52*d*. The luminescent sand provides long-lasting illumination of the viewing chamber without requiring power, gas lighting, or other ongoing maintenance to provide illumination. This could be used with any of the embodiments disclosed above.

Just as with the previous embodiment, FIG. 4 shows a gravestone marker 50 comprising a slab of granite that has been cut and polished into a rectangular gravestone marker 52, having top 76 and bottom 78 elongated members forming walls, parallel side elongated members forming side walls 72, 74, all of which form a frame 70. A back wall 52*b* glued to the other walls. The frame 70 has a central rectangular volume chamber 52*d* that has been hollowed out of the granite slab. The back wall 52*b* forms a wall of chamber 52*d*. The back wall 52*b* was originally part of the initial granite slab and was cut along the line 52*bb* so that the back wall was removed to allow the interior walls of chamber 52*d* to be highly polished especially along the rectangular interior wall corners. Once the interior chamber 52*d* walls are polished, the back wall 52*b* is permanently attached by adhesive along line 52*bb* to the rectangular marker 52 providing for the chamber 52*d*. The chamber 52*d* opening includes a peripheral rectangular supporting L-shaped ledge 52*a* that is sized to receive a permanent glass or plastic transparent sheet 54 that forms a display window. The plastic or glass sheet 54 is bulletproof and transparent. The plastic or glass sheet 54 is attached to the rectangular granite grave marker 52 within L-shaped support ledge 52*a* using adhesive 56 around the peripheral edge of sheet 54 for permanent attachment to the granite rectangular marker 52, sealing the chamber 52*d* from moisture and air.

The luminescent sand 62 could be placed just on the top face of the bottom wall 78 within the chamber 52*d*, or it could be placed within a recess 60 within that bottom face of the bottom wall 78.

The glass 54 is preferably a 9 mm toughened bulletproof glass formed by fast-cooling processes resulting in superior protective glass which retains a clear view into the chamber 52*d*.

It is to be understood that while certain embodiments and/or aspects of the invention have been shown and described, the invention is not limited thereto and encompasses various other embodiments and aspects.

The invention claimed is:

1. A permanent gravestone marker having a protected viewing chamber for photographs and memorabilia, the gravestone marker comprising:

a granite back wall for a gravesite; said granite back slab having a flat surface;

a granite base frame forming an exterior periphery rectangular in shape;

said granite base frame permanently attached to said flat surface of said granite back wall forming said viewing chamber defining an interior space;

said granite base frame and said granite back wall formed from a single granite slab, wherein said granite back wall is cut from said granite slab and said viewing chamber is hollowed out from said slab;

said exterior periphery of said granite rectangular base frame having an L-shaped ledge forming a lip about said viewing chamber;

a rectangular sheet of transparent visually clear bullet proof material firmly connected to said granite rectangular base frame along the L-shaped ledge, thereby covering said viewing chamber;

a depression within said bottom face of said viewing chamber configured for receiving said luminescent sand;

luminescent sand placed along a bottom face of said viewing chamber; and said luminescent sand configured to illuminate said interior space of said viewing chamber.

* * * * *